United States Patent [19]

Kuziw

[11] Patent Number: 4,997,012

[45] Date of Patent: Mar. 5, 1991

[54] BEVERAGE-DISPENSER CONTROL SYSTEM

[76] Inventor: Swiatoslaw Kuziw, 35 Mary Dr., Towaco, N.J. 07082

[21] Appl. No.: 294,408

[22] Filed: Jan. 9, 1989

[51] Int. Cl.[5] ..... B65B 3/04

[52] U.S. Cl. ..... 141/1; 141/83; 141/88; 177/25.19; 177/50; 222/108; 222/77

[58] Field of Search ..... 141/1, 83, 86, 88; 222/108, 77, 23; 73/861, 296; 177/25.19, 50

[56] References Cited

U.S. PATENT DOCUMENTS

| | | | |
|---|---|---|---|
| 2,040,357 | 5/1936 | Chalatow | 73/296 |
| 2,066,169 | 12/1936 | Zwosta | 222/77 |
| 2,330,857 | 10/1943 | Alcott | 73/296 |
| 2,380,249 | 7/1945 | Kuehni | 73/296 |
| 3,599,833 | 8/1971 | Relchenberger | 222/23 |
| 3,665,167 | 5/1972 | Goodwin | 222/23 |
| 3,699,315 | 10/1972 | Upton | 222/23 |
| 3,708,026 | 1/1973 | Senour | 141/83 |
| 3,863,724 | 2/1975 | Dalin, Jr. | 177/25.19 |
| 4,202,378 | 5/1980 | Bush et al. | 138/96 R |
| 4,368,640 | 1/1983 | Tokarz | 73/311 |
| 4,562,732 | 1/1986 | Kitagawa et al. | 73/296 |
| 4,712,591 | 12/1987 | McCann et al. | 141/88 |

*Primary Examiner*—Henry J. Recla
*Assistant Examiner*—Edward C. Donovan
*Attorney, Agent, or Firm*—Charles E. Baxley

[57] ABSTRACT

A method of dispensing at a tap an effervescent liquid from a keg-like supply comprises the steps of generally continuously monitoring the weight of the supply and generating an output corresponding thereto, collecting at the tap the liquid that overflows from a vessel into which it is being dispensed, weighing the collected overflow liquid and generating an output corresponding to this weight, comparing the outputs and calculating the difference therebetween, and periodically recording the difference.

6 Claims, 1 Drawing Sheet

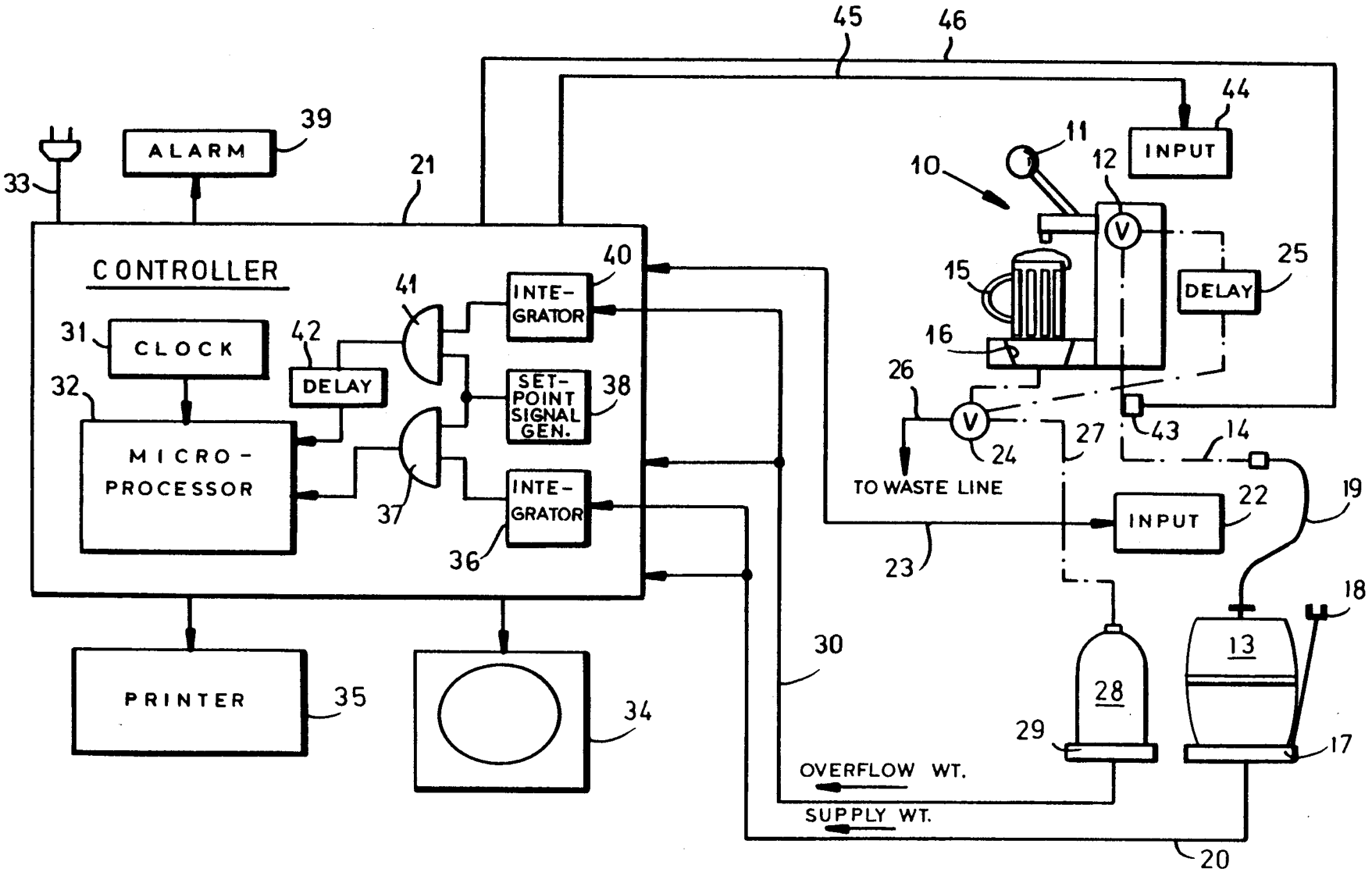
INPUT
DELAY
INPUT
TO WASTE LINE
OVERFLOW WT.
SUPPLY WT.
INTE-GRATOR
SET-POINT SIGNAL GEN.
INTE-GRATOR
DELAY
CONTROLLER
CLOCK
MICRO-PROCESSOR
ALARM
PRINTER

BEVERAGE-DISPENSER CONTROL SYSTEM

FIELD OF THE INVENTION

The present invention relates to a system for controlling the dispensing of beverages. More particularly this invention concerns the monitoring of a beer tap.

BACKGROUND OF THE INVENTION

The dispensing of beverages in draft form, that is as individual portions drawn off a large supply, combines the advantages of low unit cost and ease of vending with the disadvantages that it is nearly impossible to accurately monitor the liquid being dispensed. A keg of beer contains well upward of 100 glasses of beer and the vagaries of dispensing can waste substantial portions of this beer. In addition a dishonest bartender can give away beers to friends or sell beers and pocket the money with very little likelihood of detection while a careless bartender can forget to collect for beers dispensed without in any way knowing of the error.

A system is known, for instance from U.S. Pat. No. 2,330,857, for grossly measuring the contents of a keg. Such an arrangement, however does not provide information accurate enough for effective monitoring of a liquid often dispensed 6 oz or 8 oz at a time. Systems used for gas tanks and the like are seen in U.S. Pat. Nos. 2,380,249 and 4,368,640 for monitoring the level inside the tanks, but these arrangements do not apply to the dispensing of an effervescent liquid like beer where some is often lost to the foam overflow on filling.

Other arrangements are known from U.S. Pat. Nos. 2,040,357, 3,599,833, 3,665,167, and 4,202,378 for monitoring the dispensing of liquids right at the tap. These arrangements also are hard to manage and expensive and have found little use in reality. They also do not work for the dispensing of beer because the foam that is spilled out, in particular when the tap is fresh or the beer has gotten warm, is not accounted for.

Finally complicated devices have been suggested in U.S. Pat. Nos. 3,699,315 and 4,562,732 for monitoring liquids in closed vessels. These devices once again are not applicable to the dispensing of an effervescent liquid due to the losses inherently incurred even by a careful bartender in the course of his normal work.

Even the most complicated keg-tapping systems cannot account for how many beers have actually been drawn. Nor can they detect when underfilled kegs have been delivered or when the equipment has failed, as for instance when it is leaking or is allowing the beer to get too hot or cold.

OBJECTS OF THE INVENTION

It is therefore an object of the present invention to provide an improved system for monitoring the dispensing of a beverage.

Another object is the provision of such an improved system for monitoring the dispensing of a beverage which overcomes the above-given disadvantages, that is which accurately tracks the dispensing, even at a glass-by-glass rate, and that even takes into account the overflow losses.

SUMMARY OF THE INVENTION

A method of dispensing at a tap an effervescent liquid from a keg-like supply according to the invention comprises the steps of generally continuously monitoring the weight of the supply and generating an output corresponding thereto, collecting at the tap the liquid that overflows from a vessel into which it is being dispensed, weighing the collected overflow liquid and generating an output corresponding to this weight, comparing the outputs and calculating the difference therebetween, and periodically recording the difference.

Thus with the system according to this invention the overflow is taken into account, so that what is weighed is the beer or other liquid that is dispensed and that is not given out. What flows over the side of the glass is captured and weighed, and only the difference between the loss in weight in the supply and the gain in weight of the overflow catchment vessel is counted as being dispensed. This makes it possible to gauge with great accuracy just how much beer has been dispensed, and to compare it with the bartender's report and receipts.

According to another feature of this invention the flow of liquid from the supply to the tap is continuously monitored and an output is generated that corresponds thereto. This output is compared to a set point and a problem signal is generated when the flow output exceeds a predetermined minimum corresponding to the maximum permissible flow from the tap. This problem signal can also be generated when the rate of change of the supply weight exceeds a predetermined minimum. This minimum can correspond to the maximum possible flow through the tap, so that if a line springs a leak or something similar happens, an alarm can be issued and, of course, all the weights at that time can be recorded to avoid losing inventory control on that shift altogether.

In accordance with further features of this invention the weight outputs are recorded whenever the supply is changed. Thus a keg change in the middle of the shift will not prevent accurate inventory tracking. Of course the weight of the overflow liquid and of the supply are also recorded at each tap shift change. Thus when a new bartender signs on, he can punch in and start a new tally, and similarly when he or she signs off the tallies for the various taps are similarly registered. This can all be done automatically by linking the processor of the system of this invention with that of the cash-management system of the establishment, and in fact the system of this invention is normally coupled with a larger system that tracks inventory, employee hours, and the like. These weights are also recorded whenever power to the unit is interrupted, so that anyone tampering with the equipment will cause a so-called "tampering incident" to be recorded in the nonvolatile mass storage of the system. Such an incident is also recorded when the drain or supply weight changes at a time other then when or shortly after the tap is opened to dispense the liquid.

The rate of change of the two weight outputs is automatically calculated according to this invention, normally by integrating the actual-weight signals. A problem signal is generated whenever the rate of change of the overflow weight exceeds a predetermined percentage of the rate of change of the supply weight. This helps avoid the problem of a dishonest bartender pouring water or the like down the drain while drawing a beer to fool the system. Similarly the overflow liquid is diverted and not weighed except while the tap is actuated to dispense beer and shortly afterward to prevent the system from being circumvented. The system of this invention monitors the temperature of the beer of the supply, and generates a problem signal when the supply temperature is outside a predetermined safe range for that particular beer.

DESCRIPTION OF THE DRAWING

The above and other objects, features, and advantages will become more readily apparent from the following, reference being made to the accompanying drawing whose sole figure is a largely schematic view of the system of this invention.

SPECIFIC DESCRIPTION

As seen in the drawing a beer tap 10 has a handle 11 which, when pulled, opens a valve 12 that allows beer to flow from a pressurized keg 13 through a line 14 to a mug 15 supported at the tap 10. Beer overflowing the mug 15 is caught by a drain basin 16 under the nozzle of the tap 10.

The keg 13 is supported on a scale 17 provided with a holster 18 adapted to support a hose-type flexible tapping device 19 screwed into the top of this keg 13. The scale 17 is basically formed as a pair of plates sandwiching several resistance-type strain gauges or load cells whose resistive output is directly proportional to the weight of the keg 13 and its contents. This output is fed according to this invention via a line 20 to a controller 21. Adjacent the scale 17 is an input device 22 which can be constituted as a simple computer-type keyboard and display connected via a line 23 to the controller 21.

The drain 16 feeds overflow beer to a three-port two-way valve 24 operated jointly with the valve 12 and held open after operation by the valve for a short time by a delay 25. Normally the valve 24 diverts the liquid flowing out of the drain 16 to a drain line 26 so that it is discarded. When, however, the valve 12 is open, indicating that a beer is being drawn, and for a short time thereafter as determined by the setting of the delay, the valve 24 shunts the overflow beer to a line 27 that empties into a container 28 sitting on another scale 29 like the scale 17 and connected via a line 30 to the controller 21.

This controller 21 incorporates a clock 31 and a microprocessor 32 as well as a power supply connected to a line plug 33 and a nonvolatile mass-storage device. A display 34 and a printer 35 are also both connected to the controller 21.

In addition to being fed directly to the processor 32, the supply weight signal in the line 20 is fed to a integrator 36 whose output is fed to a comparator 37 whose other input is fed by a set-point signal generator 38. The analog-signal output of the generator 38 corresponds to he maximum possible flow rate through the line 14. The comparator 37 generates an output when the rate of flow determined by the integrator 36 exceeds this predetermined rate of flow corresponding to the set point of the generator 38 and equal to the maximum possible flow out of the tap 10. When, therefore, the system detects excessive flow in the line 14 it generates a problem signal, records all weights and the time at the printer 35, and sounds an alarm 39 to indicate that there is a leak or some tampering going on.

Similarly the overflow weight signal in the line 30 is fed to an integrator 40 whose output is fed to a comparator 41 whose other input is connected to the set-point signal generator 38. The output of the comparator 41 is fed through a delay circuit 42 to the processor 32. Thus another such problem signal is generated along with an alarm and incident report whenever the flow into the container 28 exceeds a preset percentage of the maximum possible flow out of the supply 13, indicating that something other than overflow beer is entering the drain system. The delay 42 is set to correspond t the time it normally takes liquid to flow from the tap 10 to the container 28.

In addition the line 14 is provided with a temperature sensor 43 which is connected to the controller 21 for sounding an alarm when the beer gets warmer than 45° F. or colder than 42° F., or any other temperature range for a particular beer. In addition the tap 10 is provided with another input device 44 like the device 22 but normally also key-operated that allows a bartender to sign in at the start of a shift. Such signing in automatically causes the controller 21 to print at 35 all the current weights, the current time, and normally also information identifying the new person on shift. At the end of the shift the bartender similarly checks out at 44 and normally also enters other information such as might be integrated with the establishment's cash-management system, it being noted that the beer-monitoring system of this invention is a part of such larger system.

In addition the input 22 is operated whenever a keg 13 or slop bottle 28 is changed so that the new weights can be recorded at 35, and in fact whenever anything untoward happens, such as a change in weight in the keg 13 or bottle 28 not accompanied by an actuation of the valve 12, the weights and time are recorded. During changing of a keg 13 the harness 19 is hung on the holster 18 so that its weight can be taken into account when the system is zeroed. In this manner accurate track of all of the keg beer is easily taken care of. The controller 21 substantially continuously polls the scales 17 and 19 and monitors the position of the valve 12 so that any tampering or out-of-the normal activity will be noted, and when such does occur the controller responds by recording the time and all current readings at the printer 35.

I claim:

1. A method of dispensing at a tap an effervescent liquid from a keg-like supply, the method comprising the steps of:

monitoring the initial weight of said keg-like supply of effervescent liquid;

dispensing said supply into at least one vessel having a preset volume;

generally continuously monitoring the weight of the supply after the dispensing into said at least one vessel and generating an output corresponding thereto;

collecting at the tap any liquid that overflows from a vessel into which it is being dispensed;

weighing the collected overflow liquid and generating an output corresponding to this weight;

comparing the outputs and calculating the difference therebetween;

periodically recording the difference comparing said difference with respect to the initial weight and number of vessels filled; and generating a problem signal when said difference deviates from said initial weight less the calculated weight of liquid dispensed into the number of vessels filled.

2. The dispensing method defined in claim 1, further comprising the step of:

recording the weight outputs whenever the supply is changed.

3. The dispensing method defined in claim 1, further comprising the step of:

recording the weight of each supply and of the overflow liquid at each tap shift change.

4. The dispensing method defined in claim 1, further comprising the steps of:

recording all of the weight outputs whenever power to the unit is interrupted.

5. The dispensing method defined in claim 1, further comprising the steps of:

monitoring the temperature of the beer of the supply, and generating a problem signal when the supply temperature is outside a predetermined safe range for that beer.

6. The dispensing method defined in claim 1, further comprising the step of:

diverting the overflow liquid and not weighing it except when the liquid is being dispensed and for a predetermined short time thereafter.

* * * * *